United States Patent [19]

Nelle

[11] Patent Number: 5,018,238

[45] Date of Patent: May 28, 1991

[54] HAND HELD WAND WITH ON/OFF SWITCH REMOTELY CONNECTED TO MOTOR/FAN

[76] Inventor: Joseph A. Nelle, P.O. Box 1183, Del Mar, Calif. 92014-1183

[21] Appl. No.: 353,812

[22] Filed: May 17, 1989

[51] Int. Cl.[5] ..... A47L 5/38

[52] U.S. Cl. ..... 15/314; 15/301; 15/339; 15/344

[58] Field of Search ..... 15/301, 314, 339, 344, 15/377

[56] References Cited

U.S. PATENT DOCUMENTS

| | | | |
|---|---|---|---|
| 279,373 | 3/1952 | Hälg | 15/314 |
| 3,387,319 | 6/1968 | Ferraris et al. | 15/377 X |
| 3,636,285 | 1/1972 | Wickham et al. | 15/339 X |
| 3,965,526 | 6/1976 | Doubleday | 15/377 |
| 4,042,999 | 8/1977 | Triantafyllou | 15/422 |
| 4,357,729 | 11/1982 | Vander Molen et al. | 15/377 X |
| 4,532,670 | 8/1985 | Fortune | 15/314 |

FOREIGN PATENT DOCUMENTS

| | | | |
|---|---|---|---|
| 15696 | 6/1911 | United Kingdom | 15/314 |

*Primary Examiner*—Chris K. Moore

*Attorney, Agent, or Firm*—Henri J. A. Charmasson

[57] ABSTRACT

A hand held wand with forefinger and thumb contours (75) so arranged that upon grasping the wand the index finger is automatically positioned over an on/off switch (74). The wand and switch communicate with a motor/-fan housing (39) by means of electrical conductors (81) encased in a thin profile house (80). A device specifically used to remove eraser debris from a drawing surface. The positioning of the wand over a given task and applying power to the motor/fan is accomplished with the use of one hand. The wand (73) is equipped with a hanging ring (70) for wand positioning when not in use. The hanging ring (70) when placed on the ring hook (71) holds the wand in an upright position which is convenient for the operator during his or her course of work. Airborne eraser debris is carried through the hose (80) to the motor/fan housing (39) and deposited in an air filter bag (45) enclosed within an air filter bag chamber (64). The motor/fan housing (39) has multiple means of attaching to the underside of any work station.

8 Claims, 13 Drawing Sheets

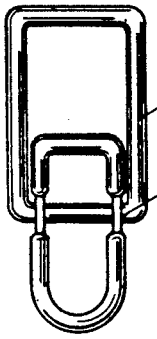
FIG. 27
FIG. 25b
FIG. 25c
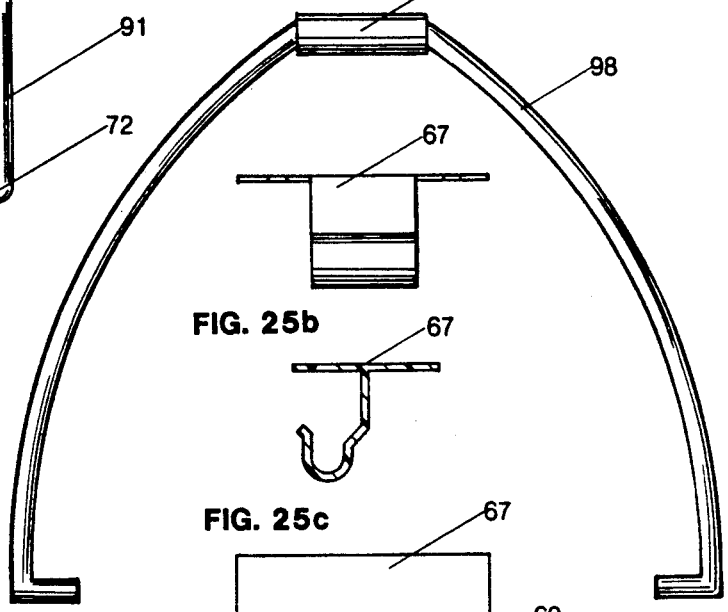
FIG. 25a
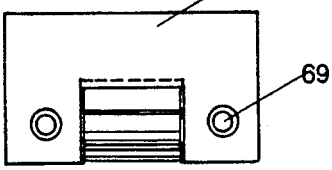
FIG. 25d
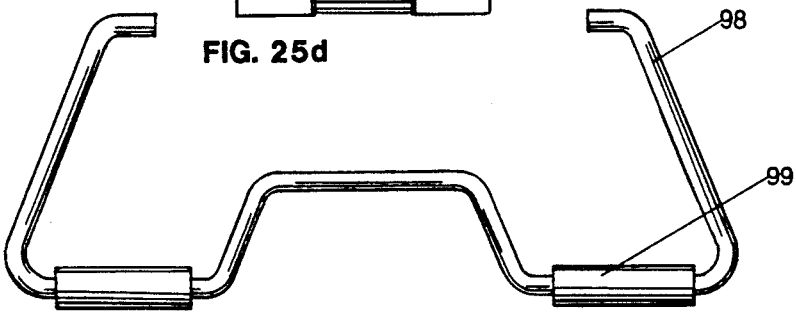
FIG. 26a
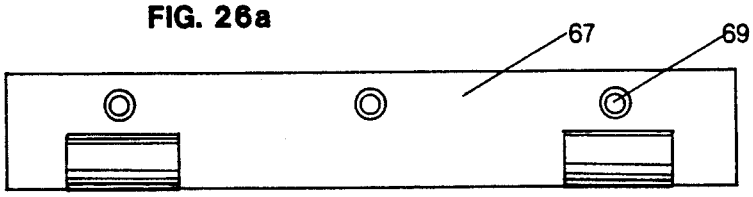
FIG. 26b
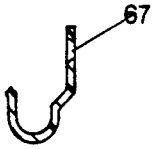
FIG. 26c
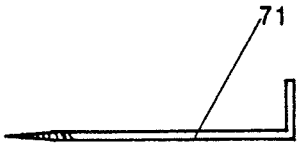
FIG. 28a
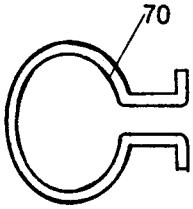
FIG. 28b
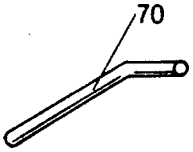
FIG. 28c

HAND HELD WAND WITH ON/OFF SWITCH REMOTELY CONNECTED TO MOTOR/FAN

BACKGROUND

1. Field of Invention

This invention relates to hand held wands and the motor/fan housings of vacuum cleaners, specifically to such devices that can be used by draftsmen within their working environment as a drawing aid to remove eraser debris from the drawing surface.

2. Description of Prior Art

Draftsmen, artists and designers have been fighting eraser debris since the invention of the eraser. For years the eraser debris has been pushed or blown from the point of origin and allowed to settle all over the work station covering books, drawing tools and everything else in its path.

Traditionally the eraser debris has been whisked aside with an inexpensive brush. With the advent of the high tech office computers, calculators and the like are on and around the work station. This unclean environment is no longer tolerable. The eraser debris can cause severe problems in electronic devices, floppy disks and the like. Simply brushing the eraser debris aside is no-longer a desirable method of dealing with the problem and there is not a product on today's market that offers an acceptable alternative. The cost of potential damage to office equipment outweighs the expense of an alternative method.

There are three basic types of vacuum cleaners and a wide variety of nozzle attachments. Examples of the three types and a typical nozzle are as follows:

The hand held vacuum as in U.S. Pat. No. 4,011,624 to Proett (1975) which discloses a device that is hand held and battery operated. This device is too bulky and will tire the operator during extended use, the large nozzle makes this device awkward when attempting to focus it on a specific task, the motor housing is not attachable by any means to or around a work station which will create an obstacle for the operator when not in use, and the inability of the device to be positioned in a ready to use stance handy to the operator renders this particular device incompatible with the working environment.

The floor canister with hose vacuum as in U.S. Pat. No. 2,351,507 to Hallock (1942) which discloses a device consisting of a main housing that rests on the floor with a flexible section of hose connected to a rigid tube with various attachments. The lack of an on/off switch located on the wand attachment for vacuum control will require the operator to exert extra effort in locating the switch during his or her course of work causing wasted time and motions, the bulky hose will result in it dragging across the drawing surface which will be disruptive to any drawing tools on the work surface causing potential damage to the surrounding art, and the hose length is not adequate to reach all areas of the work surface thus rendering this device as a useless tool for the draftsman.

The upright vacuum as in U.S. Pat. No. 4,446,594 to Ibaraki, Masas, and Sunagawa (1984) which discloses a device that rolls on the floor and is maneuvered by a handle. The physical nature of this device renders it unacceptable or incompatible with a table top working environment.

A hand held wand as in U.S. Pat. No. 4,506,406 to LaMonte (1982) which discloses a device that is attachable to a vacuum cleaner. This wand is too bulky, it is not designed for ease of gripping, it would be very difficult to direct and focus on a given task, and the absence of an on/off switch renders this device as an unacceptable alternative to the traditional brush.

OBJECTS AND ADVANTAGES

Some of the objects and advantages of the present invention are:

(a) to provide an on/off switch located in a convenient location that positions the operators index finger over the on/off switch as a result of a natural gripping action;

(b) to provide a wand that can be used in either the right or left hand;

(c) to provide a wand compact and contoured to fit comfortably in the operators hand and be easily focused on a given task;

(d) to provide a wand with means of attachment that can be placed while not in use in an upright position on the work station that is convenient and handy to the operator;

(e) to provide a wand that is attached by flexible thin profile self supporting hose that will adequately carry away the eraser debris and not drag across or lay on the work surface during its use;

(f) to provide a hose length that is adequate to reach any spot on the work surface without an excess bunching when not in use;

(g) to provide a hose with adequate integrated electrical conductors enclosed as a means of connecting the on/off switch to the motor/fan;

(h) to provide for the separation of electrical conductor chase from the air stream beginning at the point of origin and maintaining this separation to the motor/fan;

(i) to provide a motor/fan housing with numerous methods and points of attachment capable of being mounted in a variety of positions, on all possible conditions;

(j) to provide a motor/fan housing that has sound baffling without adversely affecting the air flow;

(k) to provide a compact motor/fan housing;

(l) to provide easy access for the changing of the air filter bag or in general; provide an alternative which is easy to maintain;

(m) to provide an acceptable alternative for a long needed means for the permanent removal of eraser debris;

(n) to provide a useful instrument that is easily utilized by the operator and conforms to his or her working environment becoming an inseparable and common tool of the trade; furthermore to provide a tool which can be used by other eraser using professionals other than artists, draftsmen or designers and is universally adaptable to their particular working environment;

Further objects and advantages of my invention will become apparent from a consideration of the drawings and ensuing description of it.

DRAWING FIGS. 1*a* to 28

In the drawings, closely related figures have the same number but different alphabetic suffixes.

FIGS. 1*a* and 11*a* show an isometric view of the wand, hose and motor/fan housing without legs/hangers.

FIGS. 1, 2, and 3 show the side, top, and bottom elevations of the wand.

FIG. 3*a* is a straight-on elevation of the wand body without the coupling as shown in FIG. 3.

Figure 18:
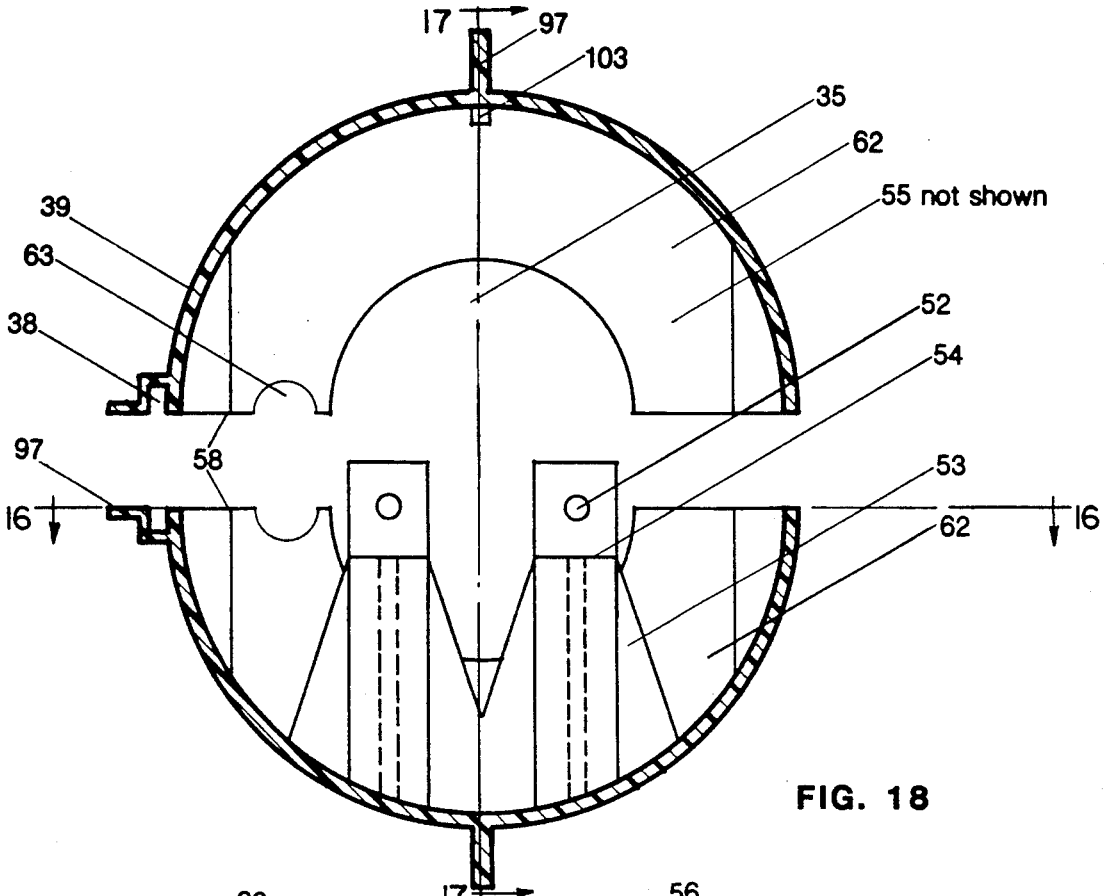
Figure 19:
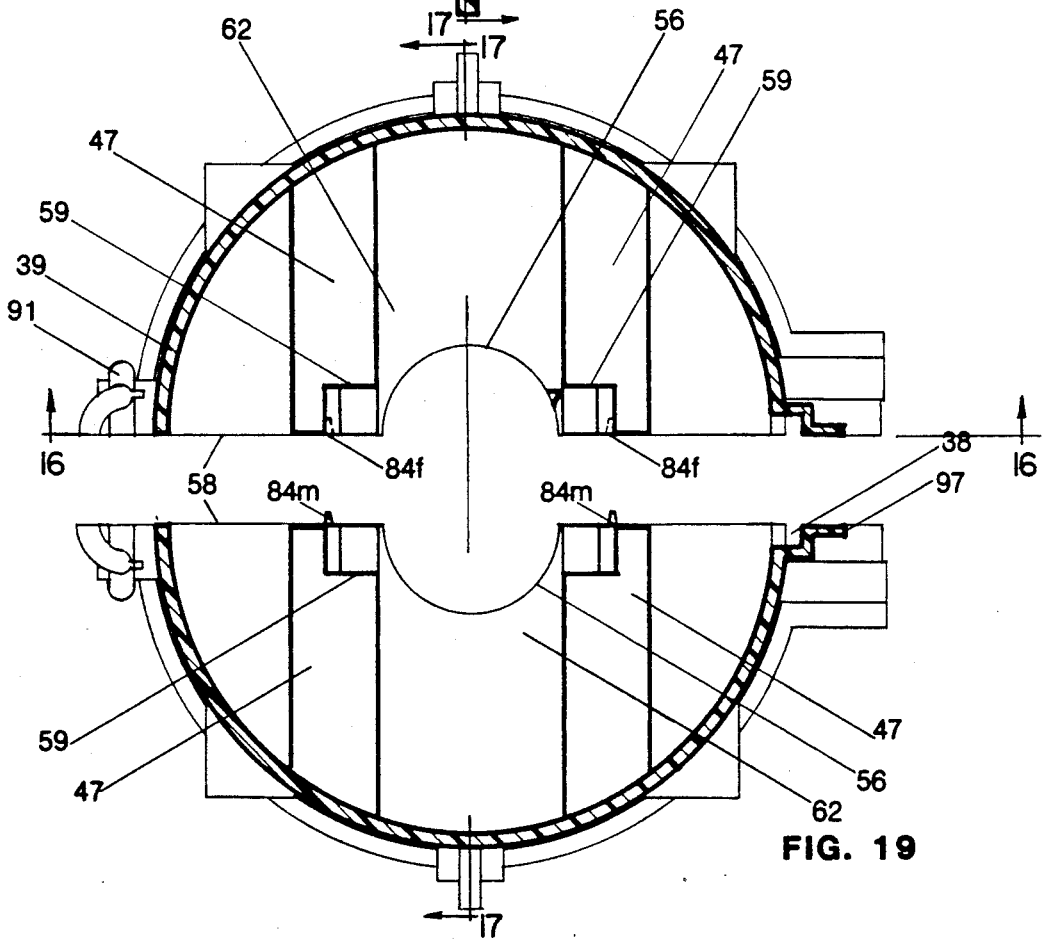

FIGS. 18 and 19 are section drawings as noted in FIGS. 11–12–13–16 and 17 by (FIGS. 18 and 19) of the motor/fan housing and lid showing front and rear motor mounts.

Figure 20:
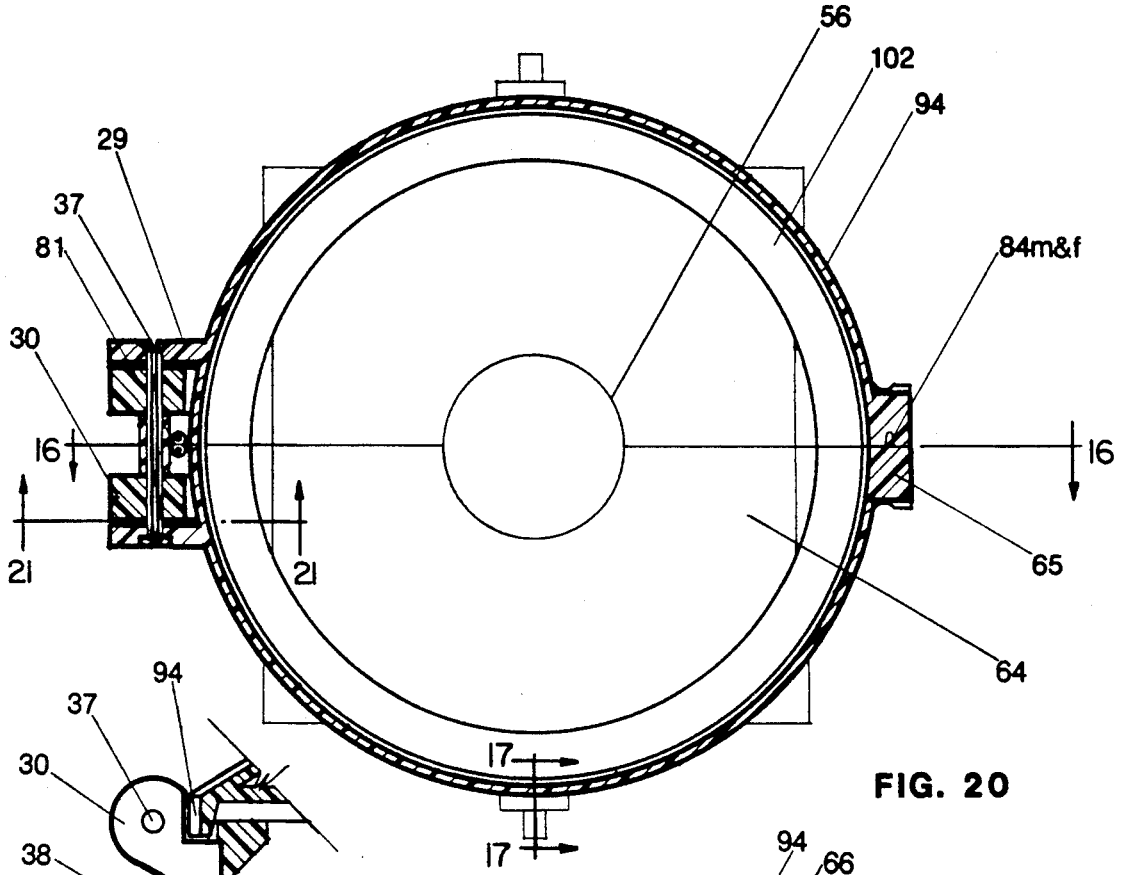
Figure 22:
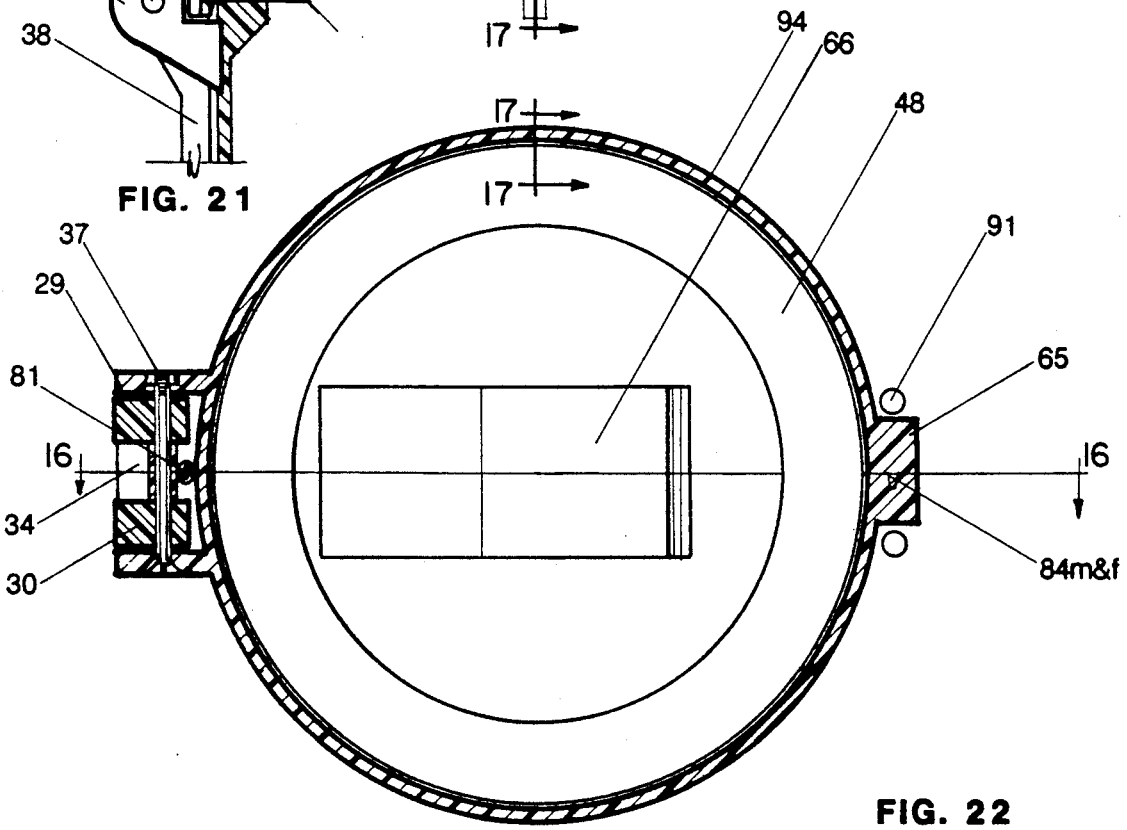

FIGS. 20 and 22 are section drawings of the lid and hinge as noted in FIGS. 11–12–13–16 and 17, one looking down on the bag rim and the other looking up at the bottom of the lid and air intake chamber.

Figure 21:
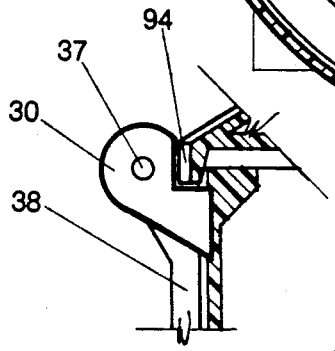

FIG. 21 is an elevation of the main hinge which is a contiguous part of the motor/fan housing and is noted in FIG. 20 by (FIG. 21).

Figure 23A:
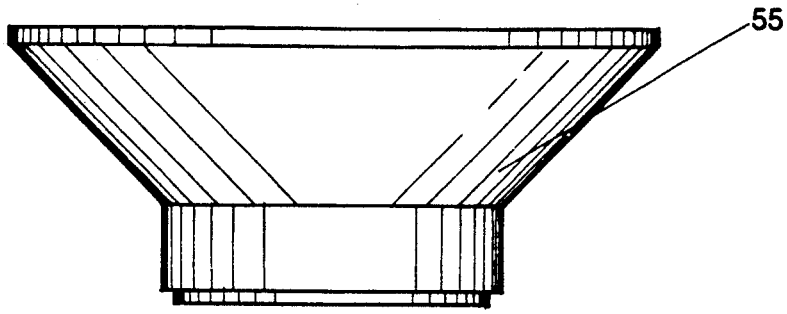
Figure 23B:
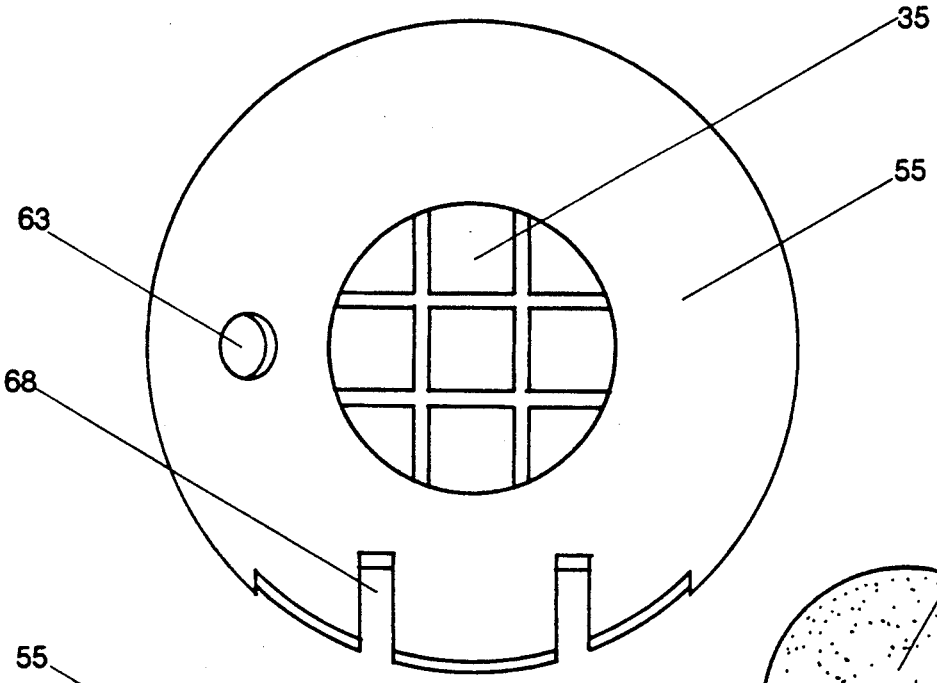
Figure 23C:
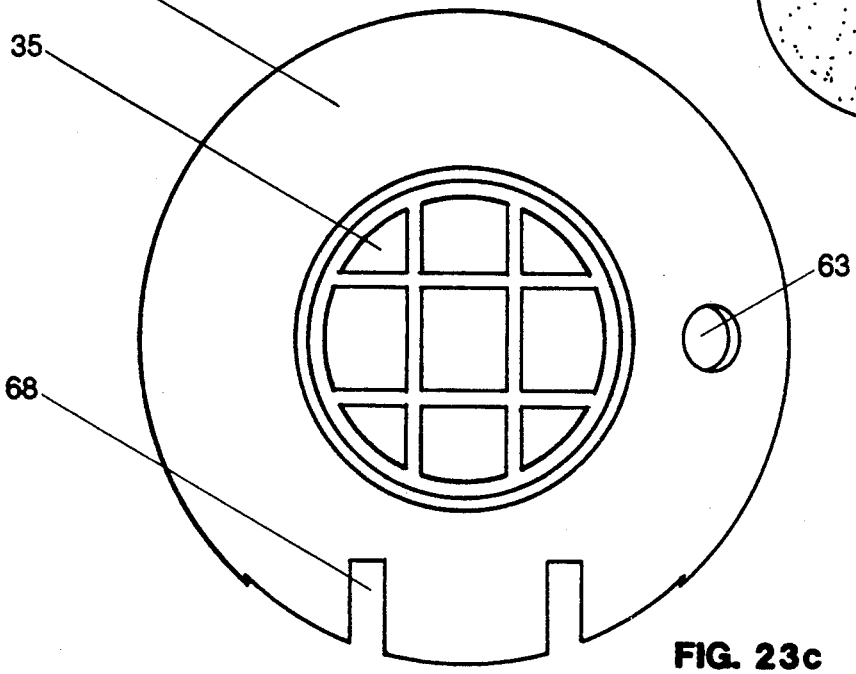

FIG. 23 are elevations of the sound baffling, where (a) is a side elevation, (b) is an elevation in the direction of air flow and (c) is an elevation of the side opposite the direction of air flow.

Figure 24A:
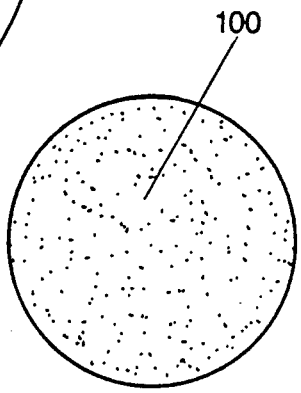
Figure 24B:
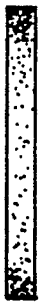

FIG. 24 are drawings of the baffling material, where (a) is a front elevation and (b) is the side elevation.

FIGS. 25(*a–d*), 26(*a–c*), 27 and 28(*a–c*) are elevations and sections of the various hanging hardware.

REFERENCE NUMERALS IN DRAWINGS

| | |
|---|---|
| 29 lid hinge | 30 motor/fan housing hinge |
| 31 lid intake | 32 air intake passage |
| 33 power supply cord | 34 lid hinge stop |
| 35 air passage opening | 36 snap-in trim ring |
| 37 hinge pin | 38 conductors chase |
| 39 motor/fan housing | 40 nut |
| 41 snap-in notch | 42 latch lip/snap |
| 43 bolt | 44 fastener channels |
| 45 air filter bag | 46 electric motor |
| 47 front motor mount | 48 gasket |
| 49 electrical twist cap | 50 tension spring |

-continued

| | |
|---|---|
| 51 anchor post | 52 bolt & hole |
| 53 rear motor mount | 54 rear motor rest |
| 55 angled baffling | 56 fan intake opening |
| 57 pin base mass | 58 machined match line |
| 59 front motor ledge | 60 bolt channel mass |
| 61 void space | 62 motor/fan chamber |
| 63 power cord opening | 64 air filter bag chamber |
| 65 lid latch lip | 66 air intake chamber |
| 67 metal bracket | 68 notches |
| 69 counter sink screw hole | 70 hanging ring |
| 71 ring hook | 72 latch ring hinge |
| 73 wand body | 74 switch |
| 75 elongated oval groove | 76 air intake opening |
| 77 hose trim ring | 78 hose/conductors coupling |
| 79 electrical conductor groove | 80 vinyl hose |
| 81 electrical conductors | 82 male projection |
| 83 hanging ring receiving holes | 84 alignment pin |
| 85 hinge post | 86 spring metal contact |
| 87 lower metal contact | 88 compression spring |
| 89 bullet | 90 compression spring |
| 91 latch | 92 leg/hanger notch |
| 93 lid | 94 lid lip |
| 95 lid brace | 96 lantern type hanger notch |
| 97 snap lock | 98 leg/hanger |
| 99 rubber pad | 100 sound absorber |
| 101 clamp lock | 102 chamber rim |
| 103 projected stop | |

DESCRIPTION—FIGS. 1 TO 28

Figure 4:
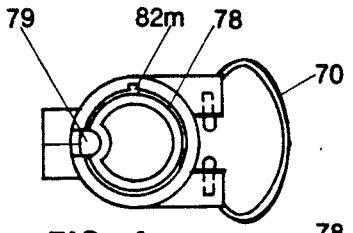
FIG. 4 is a straight-on elevation of the hose/conductor coupling and wand as shown in FIG. 1.
Figure 1:
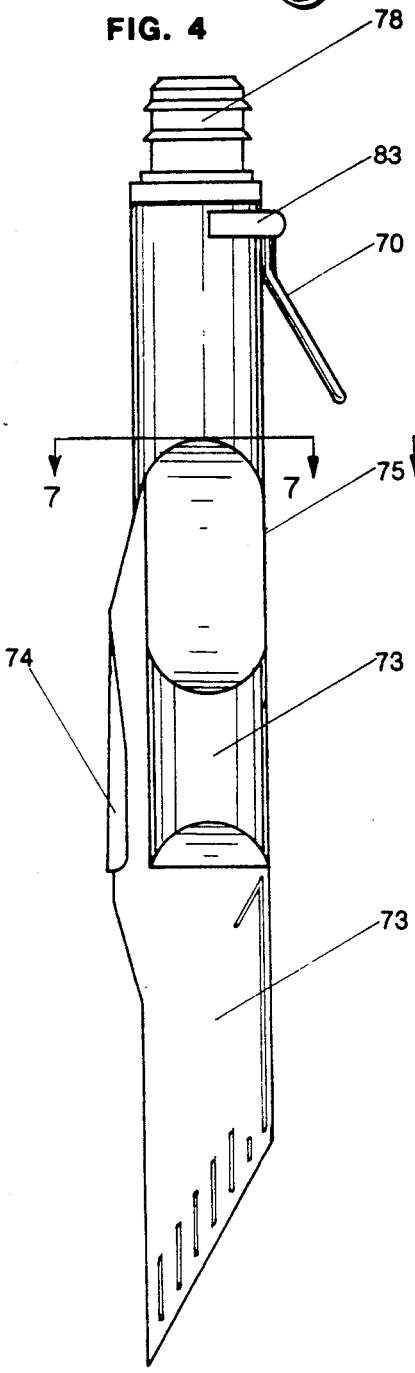
Figure 1A:
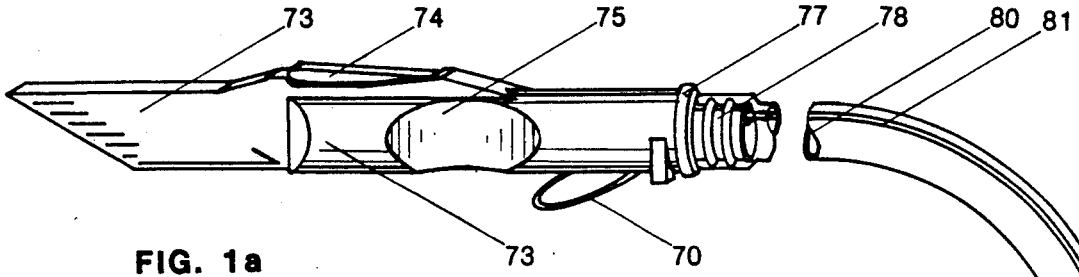
Figure 11A:
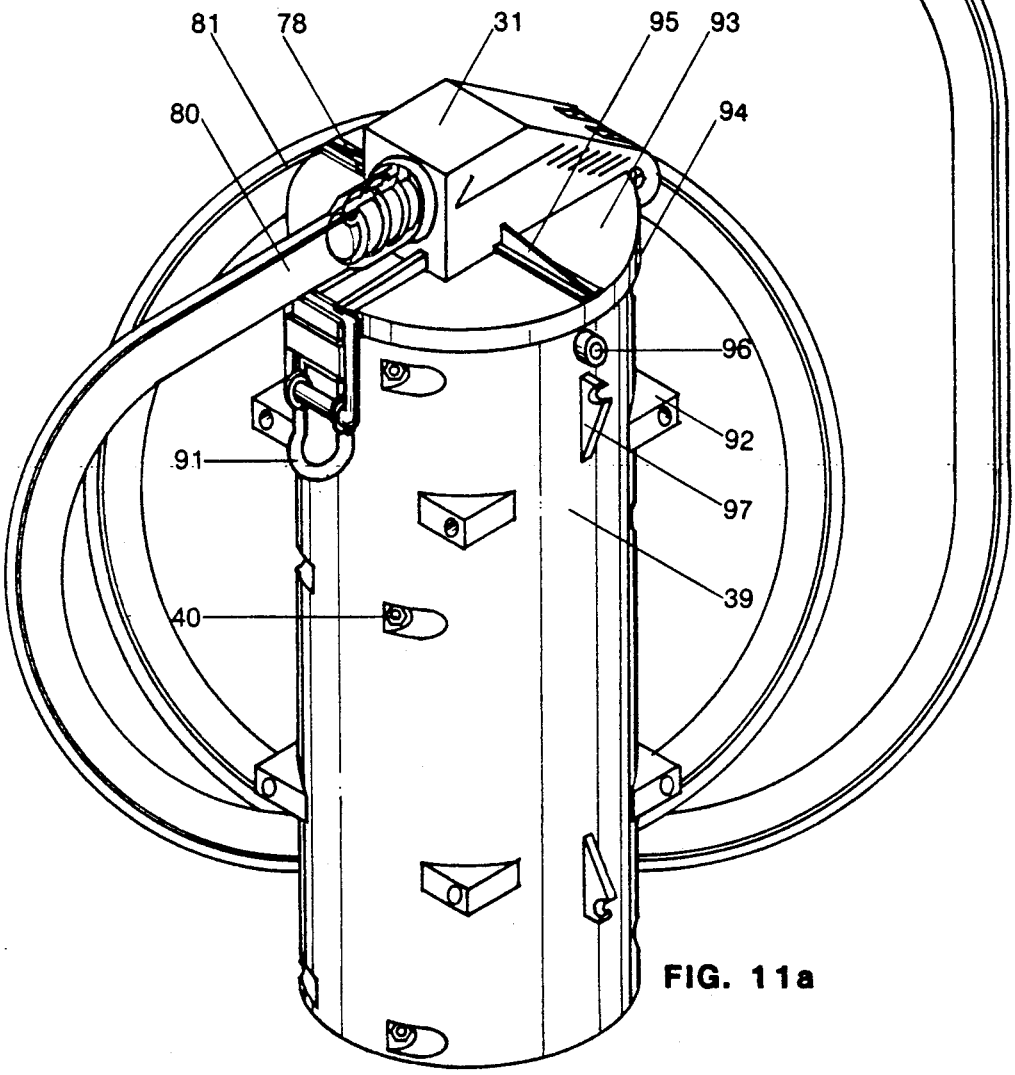
FIG. 11 is the side elevation of the motor/fan housing and lid with leg/hangers attached.
Figure 7:
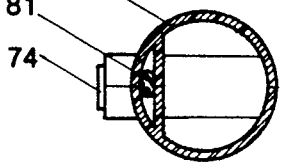
FIG. 7 is a section drawing through the wand body as noted in FIG. 6 by (FIG. 7).
Figure 8:
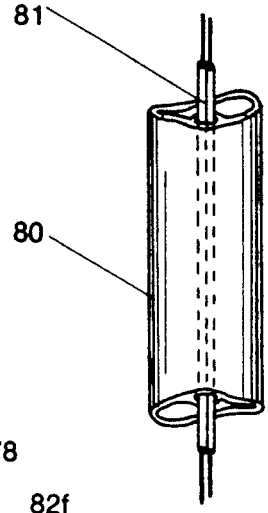
FIG. 8 is a drawing of the hose with enclosed electrical conductors.
Figure 5:
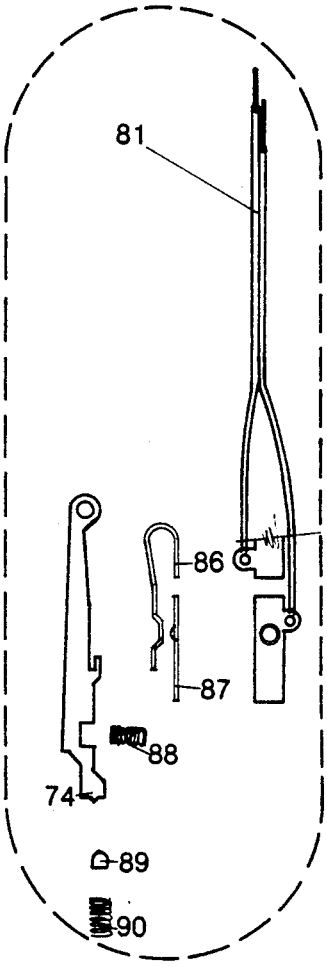

The typical embodiment of the present invention is illustrated in FIGS. 1*a* and 11*a*. The wand FIG. 1*a* is connected by vinyl hose and suitable electrical conductors to the motor/fan housing FIG. 11*a*.

Figure 2:
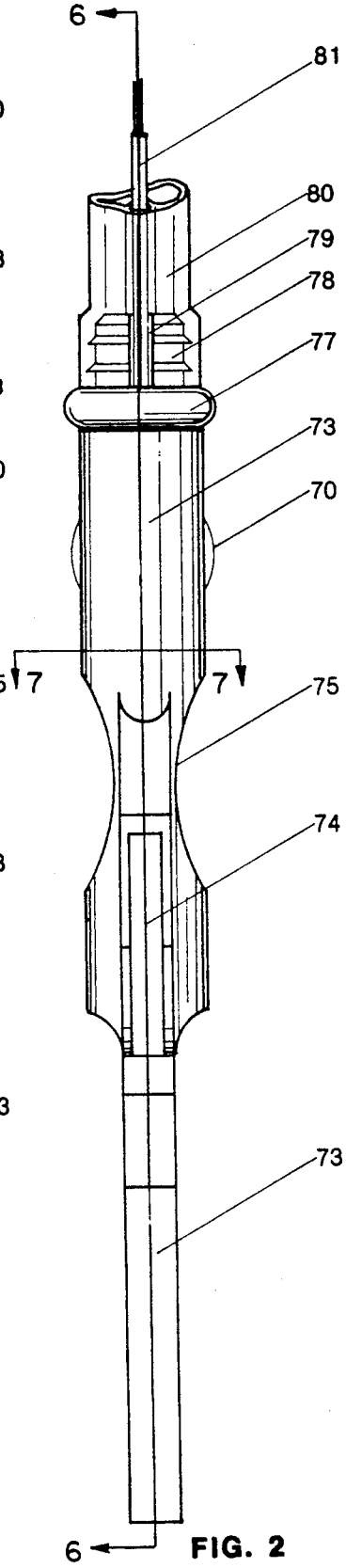
Figure 3A:
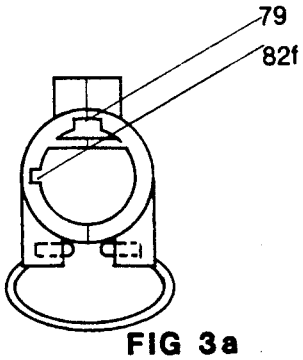
Figure 3:
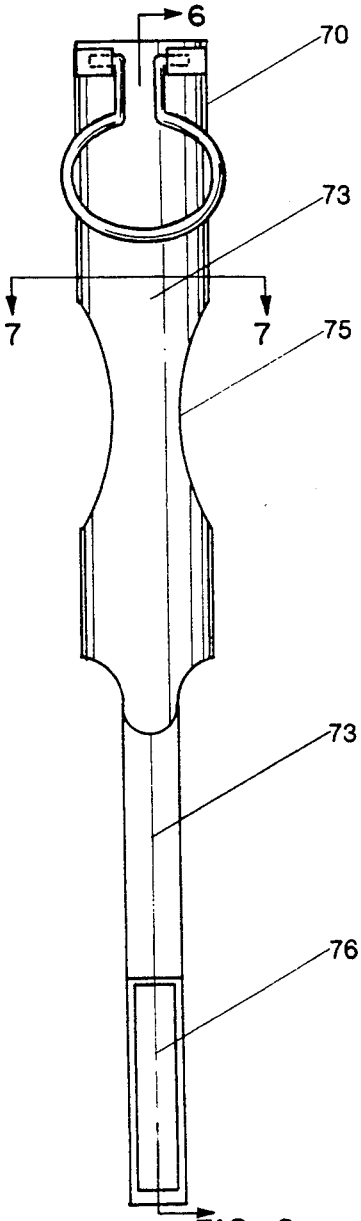
Figure 6:
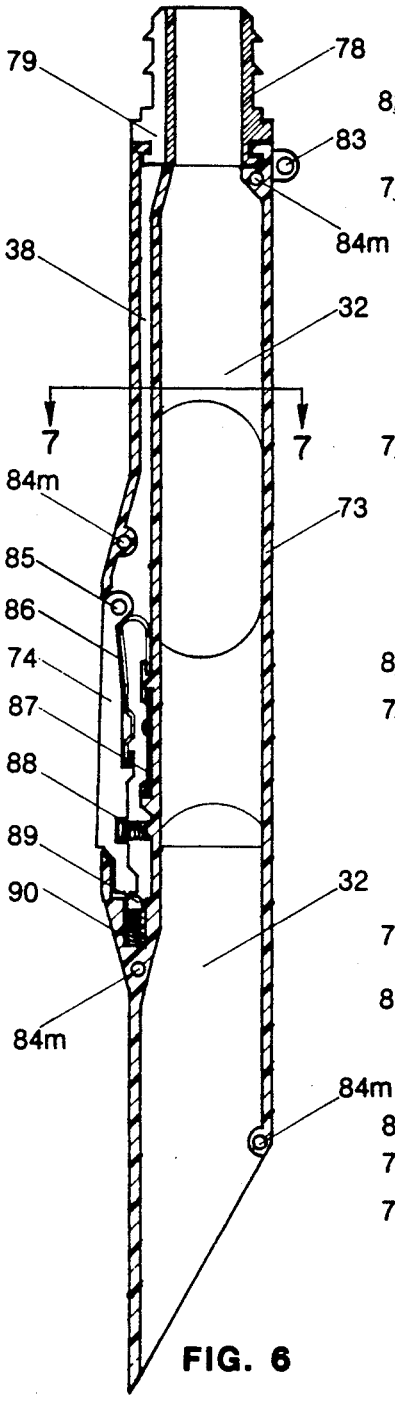
FIG. 6 is a section drawing of the wand body as noted in FIGS. 2 and 3 by (FIG. 6) exposing the electrical contacts and conductors as isolated in FIG. 5.
Figure 9C:
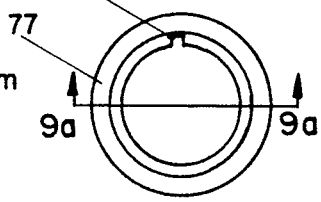
FIG. 9 are drawings of the hose trim ring, where (a) is a section as noted in the straight on elevation (c) by (FIG. 9*a*) and (b) is a side elevation of said ring.
Figure 9B:
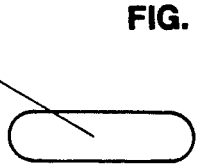
Figure 9A:
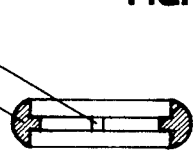
Figure 10B:
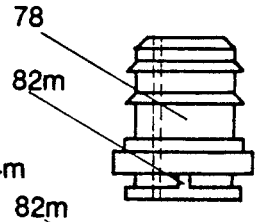
FIG. 10 are drawings of the hose/conductor coupling, where (a) is a straight-on elevation and (b) is a side elevation.
Figure 10A:
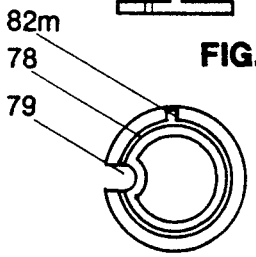
Figure 11:
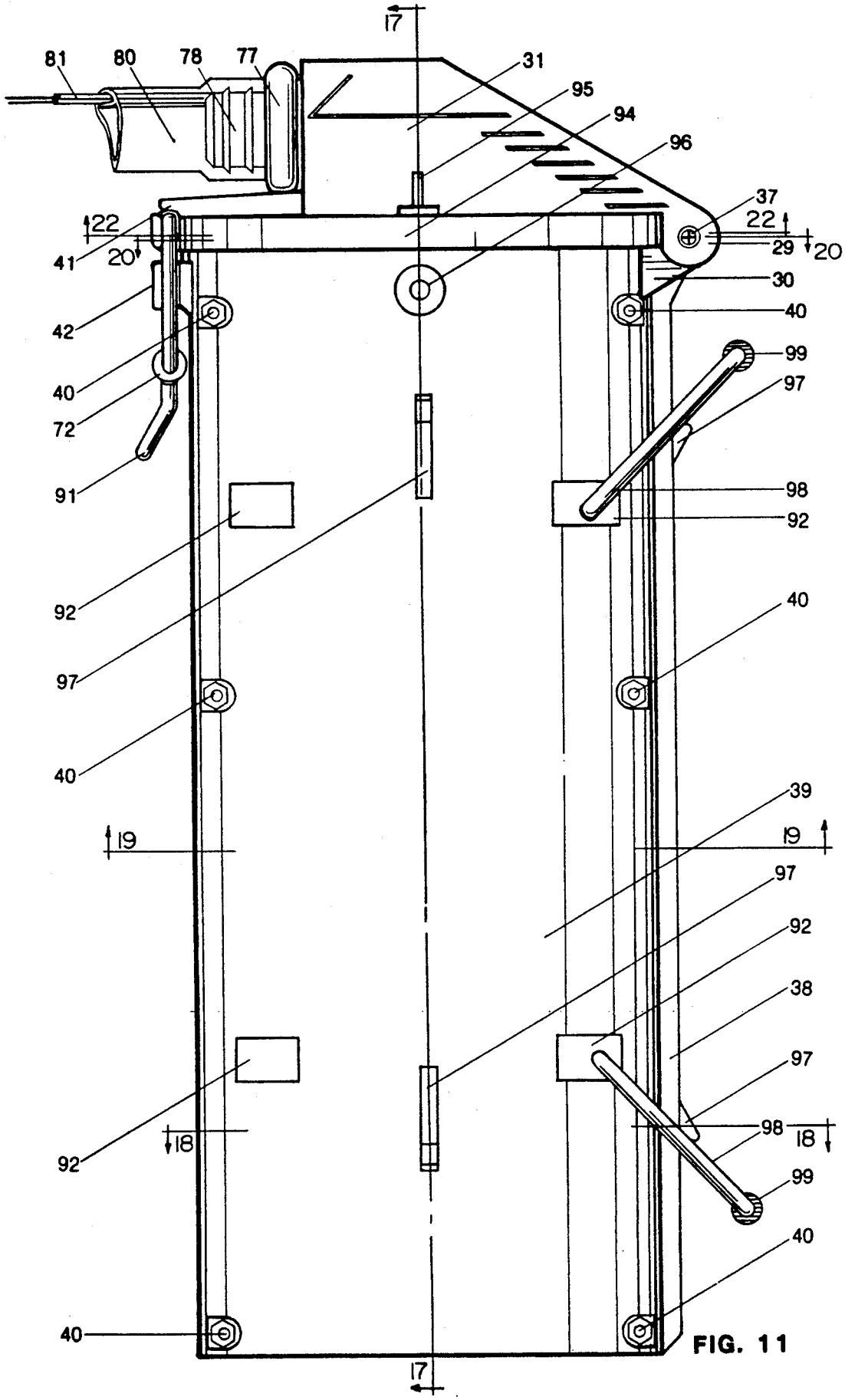
Figure 12:
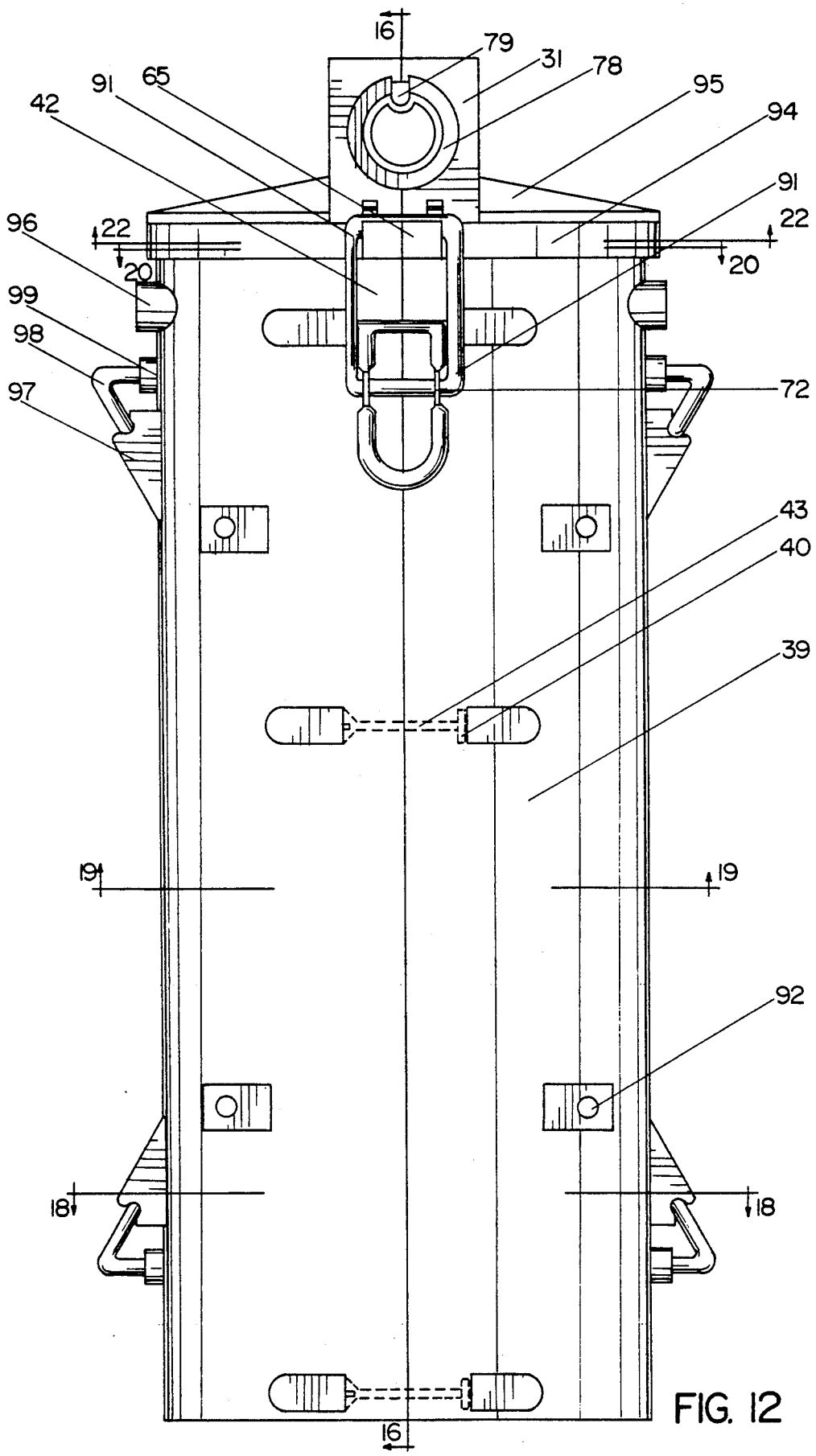
FIG. 12 is the side elevation of the motor/fan housing and lid showing a quick release latch.
Figure 13:
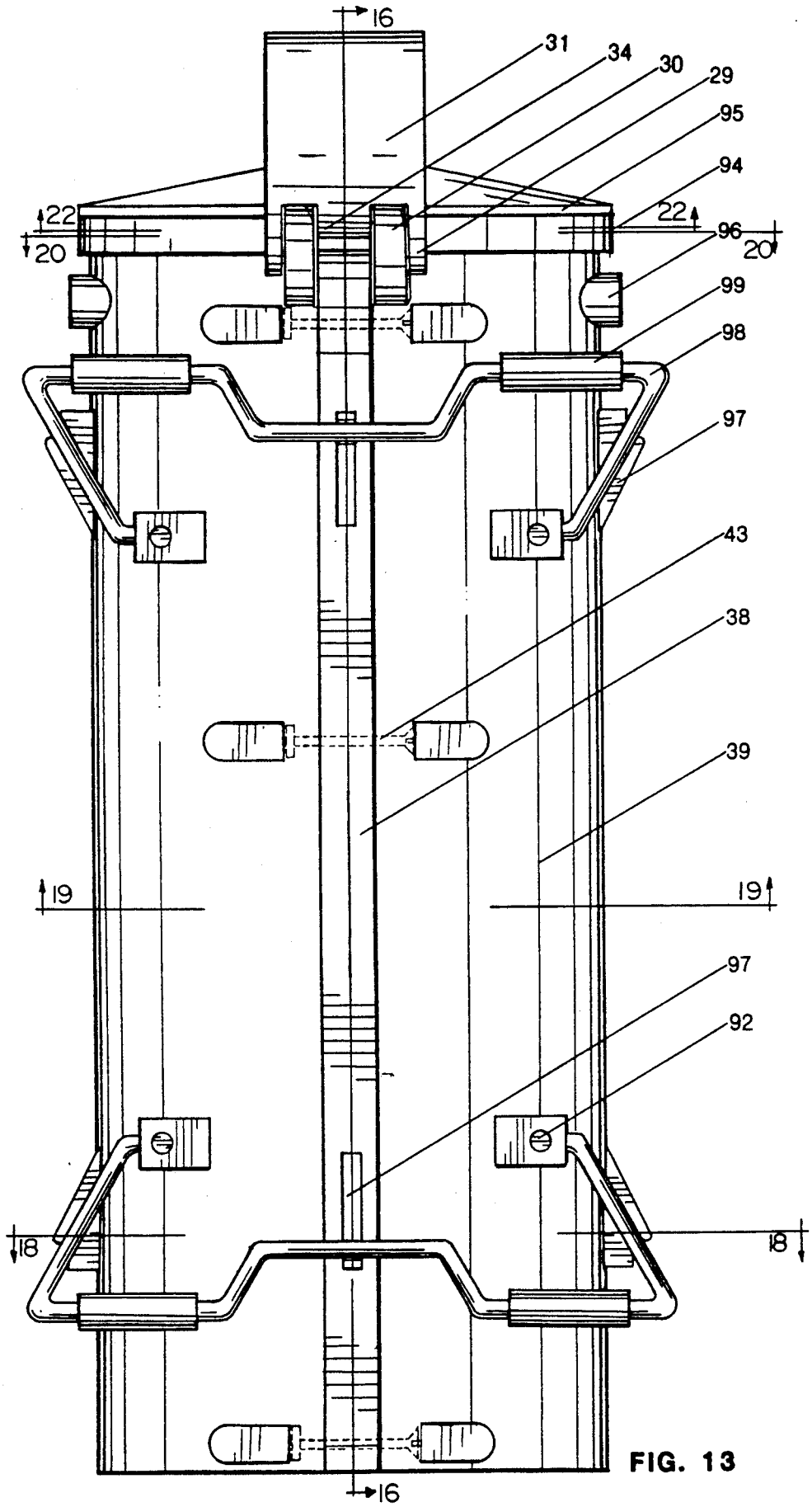
FIG. 13 is the side elevation of the motor/fan housing and lid showing the hinge and legs/hanging brackets.

The present invention is based essentially on two realizations; one, that the operator's utility and acceptance, as a practical tool, depends on the wand structure. In accordance with this concept, the wand FIG. 1*a* is composed of two halves FIG. 6 encasing an on/off switch 74 with said switch hinged at one end by a post 85. The two halves are aligned during assembly by male 84*m* and female 84*f* aligning pins encasing an air passageway. Power is applied through suitable electrical contacts 86 and 87 on a momentary basis by applying pressure to the switch 74 thus closing contacts 86 and 87. The switch has an audible click by means of a spring 90 compressing a friction bullet 89 against a ridge on the forward face of the switch 74. The switch is returned to the open position by spring action of the electrical contact 86 and by a compression spring 88 located on the swing end of the lower switch face. The electrical contacts are held in place by a raised ridge and a formed slot. Electrical current is supplied to a motor via suitable conductors 81 which are enclosed in a chase 38 separate from an air intake passage 32. The transition of the electrical conductors to the hose is through a groove 79 in a hose/conductor coupling 78 which is separate from the air intake passage. FIG. 6 shows the hose/conductor coupling held between the two wand halves by a ridge on the wand body and a channel in the coupling 78. Rotation of the coupling is prevented by a male projection 82*m* in the channel FIG. 10*b* of the coupling 78 and a female notch 82*f* in the ridge of the wand body FIG. 32. The hose is heat expanded to fit over ridges on the coupling 78 and held in place by friction from its contraction upon cooling. The hose terminates against the largest ring on the coupling 78 and the junction is covered by a trim ring 77. Rotation of the trim ring 77 is prevented by a male projection 82*m* on the coupling FIG. 10*a* and a female notch 82*f* in the trim ring 77 FIGS. 9*a* and *c*. A hanging ring 70 is angled approximately 30 degrees away from the main body of the wand and is held in place by the ring tension in two opposed receiving holes 83 at the coupling end of the wand FIGS. 1 and 3. The wand body has an elongated oval groove 75 finger grip FIG. 2 on each side and a switch 74 at the top. The foremost end of the wand or air intake opening is angled approximately 30 degrees away from the wand body.

The second essential realization of the present invention is that the adaptability of the invention to the work station depends on the motor/fan housing structure. In accordance with this concept, FIG. 11*a* shows a motor/fan housing 39. The motor/fan housing has two notches 96 on opposite sides located directly under a lid lip 94 to accommodate the insertion of a lantern type hanging bracket FIG. 25*a*. In addition, the motor/fan housing has two rows of notches 92 and snap locks 97 located at quarter points FIG. 12 on the motor/fan housing to accommodate the insertion of legs/hangers 98 FIG. 26*a*.

Figure 16:
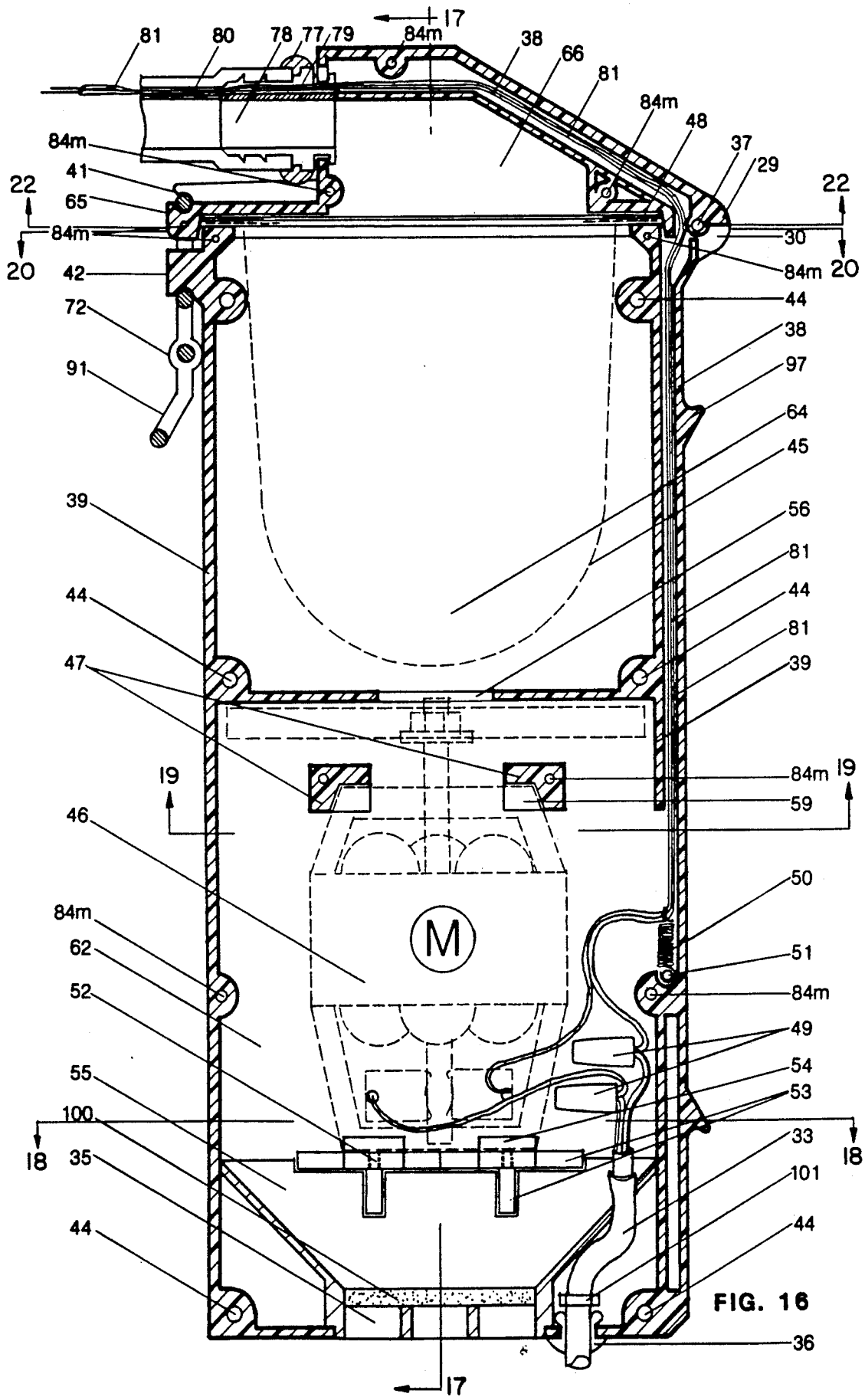
FIG. 16 is a section drawing of the motor/fan housing and lid exposing the motor, air filter bag, fan, baffling, hinge and electrical conductors as noted in FIGS. 12–13–14 and 15 by (FIG. 16).
Figure 17:
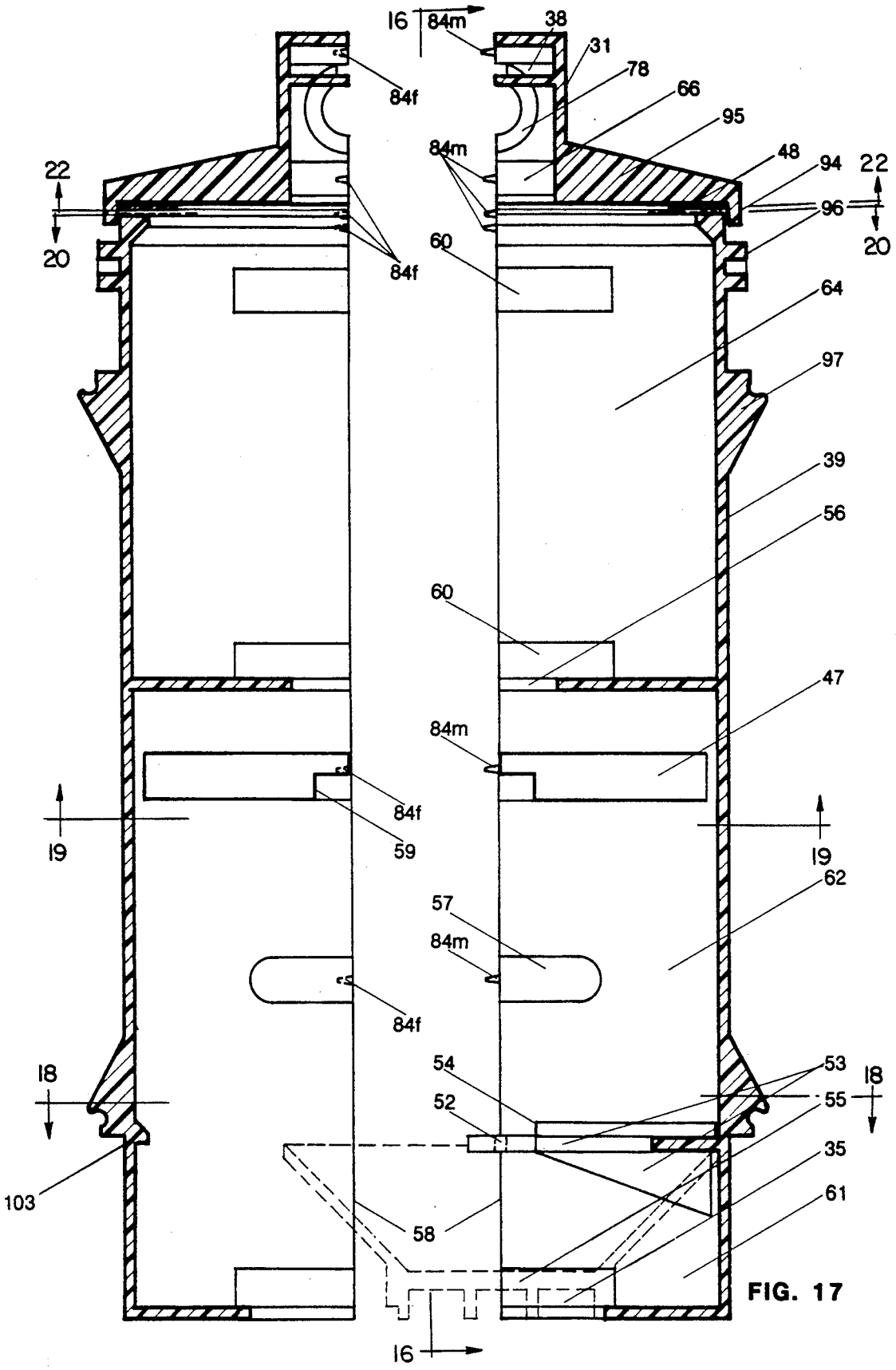
FIG. 17 is a longitudinal section through both halves of the main motor housing and lid as noted in FIGS. 11–14 and 15 by (FIG. 17) exposing the front and rear motor mounts.

The wand is connected by hose and electrical conductors to a lid intake 31 by means of the same type coupling 78 as attached to the wand. The lid intake 31 is an integral part of a lid 93 which is formed in two halves as shown in FIG. 16. FIG. 16 shows the hose/conductor coupling held between the two halves of the lid/lid intake 93/31 by an opening lip in the lid intake 31 and a channel in the coupling 78. The two halves are aligned during assembly by male 84*m* and female 84*f* aligning pins. Rotation of the coupling is prevented by a male projection 82*m* in the channel FIG. 10*b* of the coupling 78 and a female notch 82*f* in the lip of the opening on the lid intake 31 housing. The hose is heat expanded to fit over the ridges of the coupling 78 and held in place by friction from its contraction upon cooling. The hose terminates against the largest ring on the coupling 78 and the junction is covered by a trim ring 77. Rotation of the trim ring 77 is prevented by a male projection 82*m* on the coupling FIG. 10*a* and a female notch 82*f* in the trim ring 77 FIGS. 9*a* and *c*.

Electrical conductors are concealed in a conductor chase 38 separate from an air intake chamber 66. The conductors continue through a separate chase along side a hinge and down a chase 38 FIG. 16 along the hinge side of the motor/fan housing and into a motor/-fan chamber 62. Tension is maintained on the conductors during lid opening and closing by a tension spring 50 clipped to approximately 2.54 centimeters of excess conductors and anchored to a post 51. The hinge 29 has a stop 34 to prevent over extension. The conductors are connected to a motor 46 and a power supply cord 33 with the use of solder and twist caps 49. The power supply cord 33 is held in place by a snap-in trim ring 36 and a clamp lock 101.

The motor/fan housing is formed in two halves to allow placement of conductors, motor/fan and baffling. The two halves are aligned during assembly by male 84*m* and female 84*f* aligning pins and fastened together with bolts 43 and nuts 40 in formed channels 44.

The motor 46 rests between an upper and lower ledge 59 at the front mounts and is anchored at the rear motor rest 54 fastened by two bolts 52. The motor is connected by shaft to a fan. Air is pulled through a fan intake opening 56 from a air filter bag chamber 64. Airborne eraser debris is collected in an air filter bag 45 which is held into place by the clamping action of the closed lid. An air-tight seal is maintained by the compression of a gasket 48 and the air filter bags 45 upper lip being compressed between the lid 93 and a air filter bag chamber rim 102. This compression is maintained by a latch 91 opposite a fixed hinge 29 and 30. The latch 91 is snapped into a notch 41 located on a lid latch lip 65 and is wedged under a latch lip/snap 42 and snapped into place. The sides of the lid 93 are reinforced by angled braces 95 FIG. 14.

Sound baffling shown in FIG. 23 is cone shaped to channel a smooth flow of air through a porous sound absorption 100 material to a rear air passage opening(s) 35. The baffle is held in place by notches 68 FIG. 23 in the sloped face of the cone that rest against the rear motor mount 53 and the opposite side of the cone rests against a projected stop 103 FIGS. 18 and 17 on the inside surface of the motor/fan housing.

There are various possible arrangements for the working parts of the motor/fan and wand on/off switch. The same results can be achieved by using either a conventional 115 volt or a low voltage power supply. In addition, the same results can be achieved using a variety of size, shape and a variation on the number of parts in the construction of the wand and motor/fan housing. For the illustration purposes of this invention a 115 v power source, the size of embodiments, and the motor/fan arrangement, as drawn, are chosen as one alternative in producing the desired results.

From the description above, a number of advantages of my hand held wand and motor/fan housing becomes evident.

(a) An on/off switch is located on the wand allowing the operator one-handed access to the on-demand activation of the motor/fan.

(b) The embodiment of the wand permits its utilization by either a right or left handed person.

(c) The embodiment of the wand permits its utilization with the ease of a natural gripping action.

(d) The presence of a ring hanger on the wand body that holds the wand in an upright position while not in use, allowing the wand to be located in a convenient location at the work station that is easily accessible to the individual operator.

(e) The use of thin profile vinyl hose having enough flexibility to be easily maneuvered and enough self support that it will not drag across the work surface.

(f) The hose length is between 152.40 and 213.36 centimeters in length depending on the location of the mounted motor/fan housing.

(g) The switch can be located on the hand held wand remote form the motor/fan housing with the use of a hose/conductor coupling having an electrical conductor groove which separates the conductor chase from the air passageway allowing for the transition of electrical conductors/hose from the wand to the motor/fan housing.

(h) The hinge permits the continued separation of the conductor chase from the air intake chamber and air filter bag chamber and will not allow the conductors to interfere with the seal between the lid and air filter bag chamber rim.

(i) The motor/fan housing has slots for either hanging the unit under the work surface or mounting it on the side or back wall and is capable of standing on its own either on the floor or on a horizontal surface.

(j) The use of a cone shaped baffle that has three times the open area as the intake area and has a porous sound absorbing material positioned in the small end of the cone for absorbing noise produced by the motor/fan while minimizing the restriction of air flow.

(k) The overall size of the motor/fan housing as illustrated for this invention is approximately 10.16 centimeters×27.94 centimeters.

(l) One quick release latch allows for easy access to the air filter bag.

(m) The embodiments can come in many colors, various sizes and different shapes.

(n) Although there are numerous versions of vacuum cleaners on the market none have addressed the special needs of the work station as my invention has rendering the prior art impractical and cumbersome in the specified working environment.

OPERATION—FIGS. 1*a* TO 28

Figure 14:
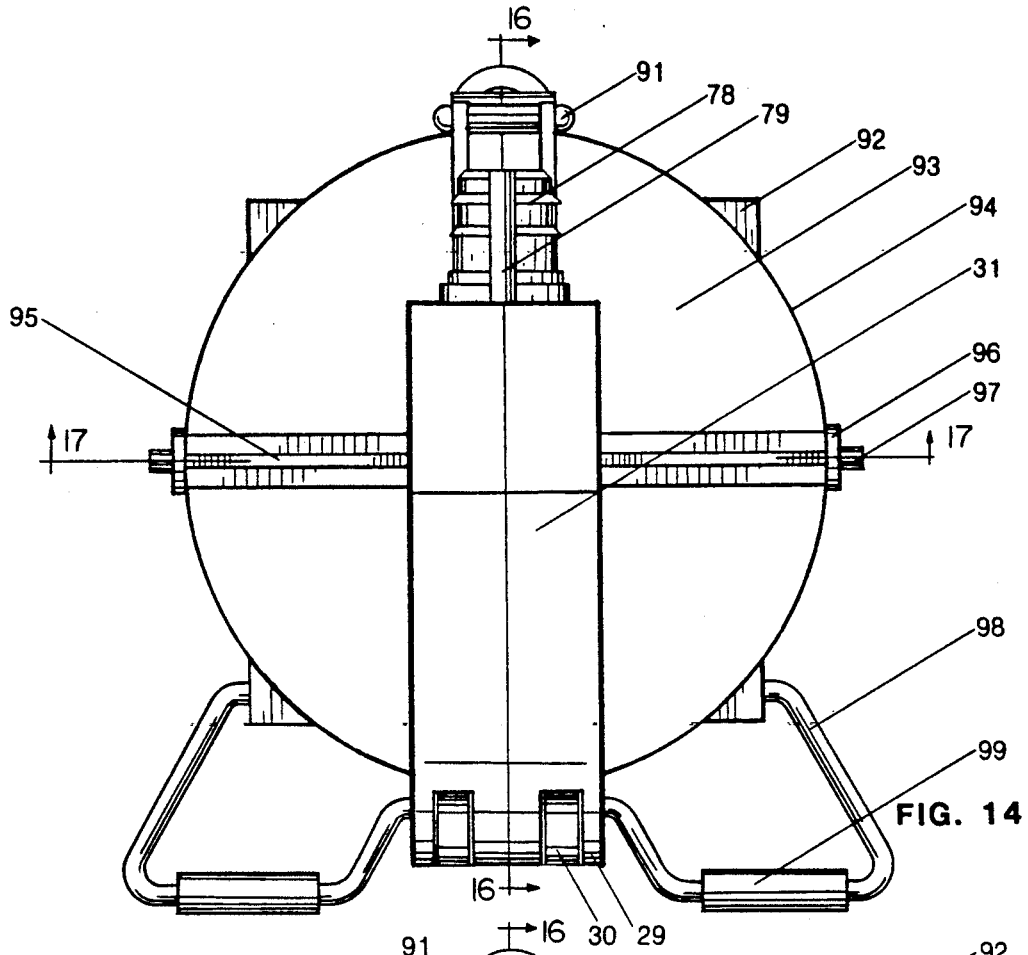
FIG. 14 is the top elevation of the motor/fan housing showing the lid with hose/conductor coupling and legs/hanging brackets.
Figure 15:
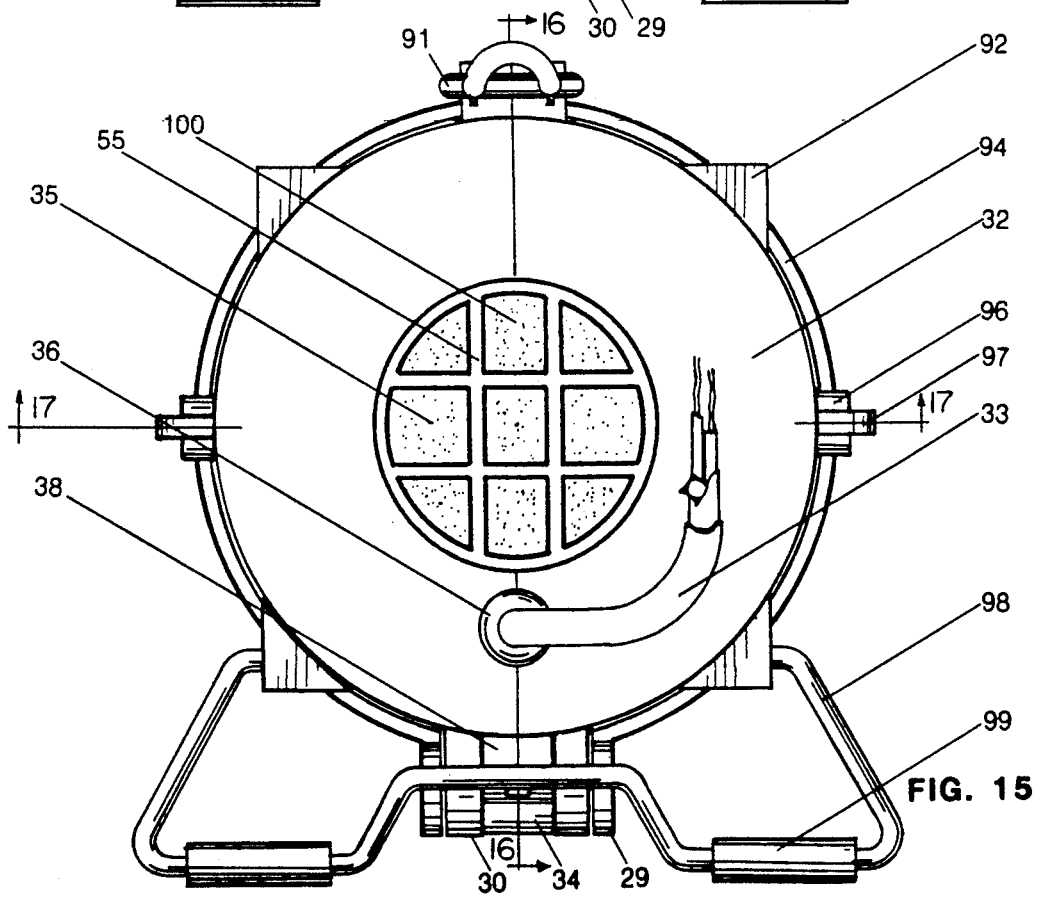
FIG. 15 is the bottom elevation of the motor/fan housing showing the exhaust port and electrical supply.

For the reason that both the motor/fan housing and the wand are adaptable to the operators working environment and provides a much needed working utility this invention becomes a practical tool of the trade. The motor/fan housing FIG. 11*a* is mounted beneath the working surface away from the operators maneuvering area. The rubber pads 99 located on the legs/hangers 98 absorb vibrations that might be transferred from the hanging brackets FIGS. 25–26 to the mounting surface. The sound abatement material in the cone baffling FIGS. 23–24 reduce the noise levels produced during motor/fan operation. The motor/fan housing can be mounted in a lantern configuration under the work surface by using the hanger FIG. 25 inserted in the notches 96 provided on the motor/fan housing and fastening the hanging bracket FIG. 25*b* to the under surface of the work station then lifting the motor/fan housing up over the bracket and lowering it down catching the rubber pad 99 on the hanger bracket 98 groove. The motor/fan housing can also be mounted to the right or left or rear wall or on a table leg by using the legs/hangers 98 and placing them in the appropriate notches 92 on the motor/fan housing and fastening the hanging bracket 26*b* to the desired wall or leg then lifting the motor/fan housing up over the bracket and lowering the motor/fan housing down and catching the rubber pads 99 on the hanger bracket 98 groove. If the work station has no surrounding walls or suitable legs then the unit can be placed on the floor or along side of the work station with the hose and coupling 78 pointing upward using the legs/hangers 98 as shown in FIG. 14.

The air filter bag can be easily changed by placing a finger between the latch 91 and motor/fan housing 39 and snapping the latch outward and raising the lid 93. The bag is held in place by the compression of the lid. The conflict between the air intake chamber 66, air filter bag chamber 64 and the conductor chase 38 is eliminated by the separation of the conductor chase 38 around the hinge 37 with any conductor slack created by opening the lid is drawn back by a tension spring 50 in the motor/fan chamber 62. The tension spring permits the lid to be operated without crimping or damaging the conductors or seal. The lid can be secured by wedging the latch under the latch lip/snap 42 and snapping it into place.

The mounting of the motor/fan housing under the work station presents the hose at the proper place in the work area. The hose length is determined by the position of the mounting. If the motor/fan housing is mounted within 15.24 to 30.48 centimeters from the front edge of the work station, a 167.64 centimeter hose is adequate. If the motor/fan housing is mounted along a back wall 228.60 centimeters is required. The presentation of the hose from the mounted motor/fan housing to the idle wand location is achieved in one smooth curve. The slack in the curved section is enough to stretch across the work station and when the wand is returned to the idle position the hose resumes the single smooth curve which is not obtrusive to the operators maneuvering space.

The hanging ring 70 on the wand body is angled approximately 30 degrees away from the main body of the wand allowing it to be hung at the work station in a convenient position handy to the operator. The wand is held in its idle position by the hanging ring 70 and hook 71 with the switch facing outward and the air intake opening 76 pointing up. As a result of the operator griping the wand the operator will find his or her thumb and forefinger slipping into the elongated oval grooves 75 FIG. 2 and the index finger being automatically positioned over the switch 74. A slight lifting action will raise the ring hanger 70 off of the ring hook 71 and the wand is ready to be positioned over its intended task. The foremost end of the wand is angled approximately 30 degrees to allow the air intake opening 76 to be in contact with the work surface while being held in a natural position. After the wand is positioned over the desired task the power to the motor/fan can be applied by increasing the pressure on the switch 74 with the index finger. As the task is completed the power is terminated by releasing the pressure on the switch 74. The angle and hoop shape of the ring hanger 70 allows for the easy and natural replacement on the ring hook 71 leaving the wand in the same upright position as before. Accordingly, the particular embodiments of the wand in regards to gripping contours, on/off switch, conductors and hose transition and hanging ring comprise a part of the significant features of the construction of this invention.

Eraser debris is removed from the work surface by the air stream originating at the air intake opening 76 and carried through the interior of the wand body 73. The eraser debris continues through the interior of the hose 80 and on through the air intake chamber 66 into the air filter bag chamber 64 where it is separated from the air stream and collected in the air filter bag 45. The clean air continues through the fan intake opening 56 across the fan blades and motor 46 and is channeled through the baffling cone 55. The clean air is exhausted through a noise absorbing 100 material and released to the outside.

SUMMARY, RAMIFICATIONS, AND SCOPE

Accordingly, the reader will see that the hand held wand and motor/fan housing of this invention can be used by draftsmen, artists and designers as well as other professionals as a useful tool for removing eraser debris from the work surface. In addition, the invention can be easily arranged for the purpose of being attached to a wide variety of work stations of different types, styles and varying physical characteristics. Furthermore, the wand and vacuum has the additional advantages in that:

it permits the operator to use only one hand, either left or right, and be able to focus the wand on the given task and apply power as he or she desires;

it permits the operator to station the idle wand in a position and place that is convenient to his or her particular work station and in accordance to his or her particular work habits;

it provides the operator with a superior means of eliminating eraser debris at the source;

it provides the operator with a useful vacuum tool that is adaptable to his or her particular work environment and work station and will not disturb or disrupt the working surface or individual work sequence;

it permits the operator to mount the motor/fan housing under the work station away from the operators maneuvering area;

Although the description above contains many specificities, these should not be construed as limiting the scope of the invention but as merely providing illustrations of some of the presently preferred embodiments of this invention. For example, the motor/fan housing and the wand can have other shapes such as oval, trapezoidal, triangular, square, etc. Unibody construction can be used in lieu of joining two halves. Wand body and motor/fan housing materials can be metal, plastic, aluminum, etc. The invention can come in any color or combination thereof. A low voltage or battery power source can be utilized in lieu of the conventional 115 volt. Various arrangements of the internal working parts and air stream exhaust are also possible.

While one specific embodiment of this invention has been illustrated and described, and certain alternatives have been briefly mentioned, it will be clear to those skilled in the art that various changes and modifications can be made from the illustrated construction while still incorporating the essential teachings of this invention. Accordingly, it is intended that the appended claims cover all such changes and modifications as may fall within the true spirit and scope of this invention.

I claim:

1. An apparatus for clearing a work surface from dust and small debris which comprises:

an air-sucking assembly having an air inlet;

a wand substantially commensurate with a pen and other articles which can be held between thumb and index finger of one hand;

said wand comprising a hollow tubular body having an intake opening at a working tip and an outlet at a proximal end opposite said tip;

a control switch mounted on the outer surface of said body;

a flexible conduit connecting said outlet to said air inlet; and a suspending ring rotatively attached to said body.

2. The apparatus of claim 1, wherein said tip comprises a flattened section of said body defining an oblong intake opening.

3. The apparatus of claim 2, wherein said body comprises a first arcuately depressed median area shaped, dimensioned and positioned to receive the tip of said index finger.

4. The apparatus of claim 3, wherein said body comprises a second arcuately depressed median area shaped, dimensioned and positioned opposite said first arcuately depressed median area to receive the tip of said thumb.

5. The apparatus of claim 4, wherein said control switch is generally located between said first and second arcuately depressed areas.

6. The apparatus of claim 2, wherein said air-sucking assembly comprises:

a motor and fan assembly;

a tubular canister housing said motor and fan assembly;

a lead at one end of said canister having said air intake; and means for holding said canister in an axially horizontal position over a flat surface.

7. The apparatus of claim 6, wherein said means for holding comprise at least one leg held in a plane intersecting said canister.

8. The apparatus of claim 7, wherein said leg comprises a length of metal rod bent into the shape of a trapeze leaving a gap in the median section of the shortest side of the trapeze; and the ends of said length of rod engaging support cavities in the walls of said canister.

* * * * *